US010371015B2

(12) United States Patent
Jeong et al.

(10) Patent No.: US 10,371,015 B2
(45) Date of Patent: Aug. 6, 2019

(54) SUPERCRITICAL $CO_2$ GENERATION SYSTEM FOR PARALLEL RECUPERATIVE TYPE

(71) Applicant: DOOSAN HEAVY INDUSTRIES & CONSTRUCTION CO., LTD, Changwon-si, Gyeongsangnam-do (KR)

(72) Inventors: Cheol Rae Jeong, Incheon (KR); Seung Gyu Kang, Yongin-si (KR); Jeong Ho Hwang, Yongin-si (KR); Byoung Gu Bak, Pohang-si (KR); Eung Chan Lee, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 89 days.

(21) Appl. No.: 15/698,436

(22) Filed: Sep. 7, 2017

(65) Prior Publication Data

US 2018/0142581 A1 May 24, 2018

(30) Foreign Application Priority Data

Nov. 24, 2016 (KR) ..... 10-2016-0157112

(51) Int. Cl.

| | |
|---|---|
| ***F01K 25/10*** | (2006.01) |
| ***F01K 13/00*** | (2006.01) |
| ***F01K 21/00*** | (2006.01) |
| *F01D 15/10* | (2006.01) |

(52) U.S. Cl.

CPC ..... *F01K 25/103* (2013.01); *F01D 15/10* (2013.01); *F01K 13/006* (2013.01); *F01K 21/00* (2013.01)

(58) Field of Classification Search

CPC ..... F01K 7/32; F01K 25/10; F01K 25/103
USPC ..... 60/647
See application file for complete search history.

(56) References Cited

U.S. PATENT DOCUMENTS

| | | | | |
|---|---|---|---|---|
| 7,096,665 | B2 * | 8/2006 | Stinger | F01K 25/08 60/651 |
| 9,624,793 | B1 * | 4/2017 | Pasch | F01K 7/16 |
| 2012/0047892 | A1 * | 3/2012 | Held | F01K 3/185 60/652 |

(Continued)

FOREIGN PATENT DOCUMENTS

| | | | |
|---|---|---|---|
| JP | 2011256818 | A * | 12/2011 |
| JP | 2012-145092 | A | 8/2012 |

(Continued)

OTHER PUBLICATIONS

Kimzey, G., "Development of a Brayton Bottoming Cycle using Supercritical Carbon Dioxide as the Working Fluid", Electric Power Research Institute Report, Palo Alto, CA (2012), pp. 1-31.

(Continued)

*Primary Examiner* — Laert Dounis
(74) *Attorney, Agent, or Firm* — Invenstone Patent, LLC

(57) ABSTRACT

A supercritical CO2 generation system for a parallel recuperative type capable of improving generation efficiency and saving costs is disclosed. According to the supercritical CO2 generation system according to the exemplary embodiment, a compression ratio of a turbine can be increased by arranging recuperators in parallel, thereby maximizing work of the turbine.

18 Claims, 13 Drawing Sheets

(56) References Cited

U.S. PATENT DOCUMENTS

| | | | | |
|---|---|---|---|---|
| 2012/0131921 | A1* | 5/2012 | Held | F01K 25/08 60/671 |
| 2014/0000261 | A1* | 1/2014 | Freund | F01K 25/103 60/671 |
| 2014/0102101 | A1* | 4/2014 | Xie | F01K 25/103 60/647 |
| 2015/0076831 | A1 | 3/2015 | Giegel | |
| 2016/0326916 | A1* | 11/2016 | Roh | F02C 1/08 |
| 2017/0107860 | A1* | 4/2017 | Kim | F01K 7/16 |
| 2017/0234266 | A1* | 8/2017 | Hwang | F01K 7/16 60/645 |

FOREIGN PATENT DOCUMENTS

| | | | |
|---|---|---|---|
| KR | 20050056941 | A | 6/2005 |
| KR | 10-2014-0116504 | A | 10/2014 |
| KR | 10-2015-0036155 | A | 4/2015 |
| KR | 10-1638287 | B1 | 7/2016 |

OTHER PUBLICATIONS

Kimzey, G., "Supercritical CO2 Brayton Cycles and Their Application as a Bottoming Cycle," Project Summary Webcast , Sep. 7, 2017, Electric Power Research Institute.

A Korean Office Action dated Aug. 17, 2018 in connection with Korean Patent Application No. 10-2016-0157112 which corresponds to the above-referenced U.S. application.

* cited by examiner

Prior Art

Prior Art

Prior Art

Prior Art

SUPERCRITICAL $CO_2$ GENERATION SYSTEM FOR PARALLEL RECUPERATIVE TYPE

CROSS-REFERENCE TO RELATED APPLICATION

This application claims priority to Korean Patent Application No. 10-2016-0157112, filed on Nov. 24, 2016, the disclosure of which is incorporated herein by reference in its entirety.

BACKGROUND

Exemplary embodiments of the present invention relate to a supercritical $CO_2$ generation system for a parallel recuperative type, and more particularly, to a supercritical $CO_2$ generation system for a parallel recuperative type capable of improving generation efficiency and saving costs.

Internationally, as a necessity for efficient power production is increasing more and more and a movement to reduce pollutant emissions is becoming more and more active, various efforts to increase power production while reducing the occurrence of pollutants have been conducted. As one of the efforts, research and development into a generation system using supercritical $CO_2$ as a working fluid as disclosed in Japanese Patent Laid-Open Publication No. 2012-145092, for example, has been actively conducted.

The supercritical $CO_2$ has a density similar to a liquid state and viscosity similar to gas, such that equipment may be miniaturized and power consumption required to compress and circulate the fluid may be minimized. At the same time, the supercritical $CO_2$ having critical points of 31.4° C. and 72.8 atm is much lower than water having critical points of 373.95° C. and 217.7 atm, and thus may be handled very easily. The supercritical $CO_2$ generation system shows pure generation efficiency of about 45% when being operated at 550° C. and may improve generation efficiency by 20% or more as compared to that of the existing steam cycle and reduce the size of a turbo device.

FIG. 1 is a schematic diagram showing the existing Electric Power Research Institute (EPRI) proposed cycle.

According to the EPRI proposed cycle of FIG. 1, two turbines 400 are provided. Work of the turbines 400 is transmitted to the compressor 100, and a generator 150 is connected to the compressor 100 via a gear box 130. The compressor 100 is driven by the work of the turbines to compress a working fluid. The work of the turbines 400 transmitted to the compressor 100 is transmitted to an output corresponding to an output frequency of the generator 150 through the gear box 130 and transmitted to the generator 150. A recuperator 200 and heat exchanger 300 using an external heat source, such as waste heat or the like, are provided in plural, and the plurality of recuperators 200 and heat exchangers 300 are arranged in series.

The supercritical $CO_2$ working fluid compressed by the compressor 100 is branched from the first separator S1, and some thereof is transmitted to a low temperature heater 330 and some thereof is transmitted to a low temperature recuperator 230. A working fluid heated by a low temperature heater 330 is transmitted to a first mixer M1. The working fluid transmitted to the low temperature recuperator 230, which exchanges heat with the working fluid transmitted to a pre-cooler 500, is primarily heated and then transmitted to the first mixer M1. The working fluid mixed by the first mixer M1 is transmitted to a second separator S2 where the working fluid is branched and transmitted to a high temperature heater 310 and to a high temperature recuperator 210.

The working fluid transmitted to the high temperature heater 310 is transmitted to a first turbine 410 to drive the first turbine 410 and the working fluid transmitted to the high temperature recuperator 210 that exchanges heat with the working fluid passing through the first turbine 410 is heated and then transmitted to a second turbine 430 to drive the second turbine 430.

The working fluid that is heat-exchanged by the high temperature recuperator 210 through the first turbine 410 and then primarily cooled is transmitted to a second mixer M2, and is mixed with the working fluid passing through a second turbine 430 by the second mixer M2 and transmitted to the low temperature recuperator 230. The working fluid transmitted to the low temperature recuperator 230 exchanges heat with the working fluid branched from the first separator S1 to be secondarily cooled, then transmitted to the pre-cooler 500 to be re-cooled, and then transmitted to the compressor 100.

In the case of the EPRI proposed cycle described above, in order to maximize the work of the turbine, it is necessary to increase a pressure ratio of the turbine 400. Since the recuperator 200 is arranged in series, the working fluid passes through the recuperator 200 twice. As a result, pressure loss increases, which leads to a reduction in the work of the turbine. In addition, since a flow rate introduced into the low temperature recuperator 230 through the turbine 400 is always a total flow rate of the system, there is a problem in that the heat exchange is inefficient at a junction point of either the first mixer M1 and the second mixer M2 due to constraint conditions where an outlet temperature 5 of a low temperature fluid and an outlet temperature C of the low temperature heater 330 needs to be minimized and a difference between an inlet temperature 1 of a high temperature fluid and an outlet temperature 3 of the high temperature recuperator 210 needs to be minimized.

SUMMARY

A supercritical CO2 generation system for a parallel recuperative type capable of improving generation efficiency and saving costs is described. Other advantages can be understood by the following description, and become apparent with reference to the exemplary embodiments disclosed and can be realized by what is claimed and combinations thereof.

In accordance with one aspect, a supercritical $CO_2$ generation system for a parallel recuperative type includes a compressor compressing a working fluid, a plurality of heat exchangers being supplied heat from an external heat source to heat the working fluid, a plurality of turbines driven by the working fluid, a plurality of recuperators exchanging heat between the working fluid passing through the turbine and the working fluid passing through the compressor to cool the working fluid passing through the turbine and installed in parallel, and a pre-cooler cooling the working fluid primarily cooled by the recuperator and supplying the cooled working fluid to the compressor.

The working fluid passing through the compressor may be branched to the heat exchanger and the recuperator from a rear end of the compressor, respectively.

The recuperator may include a first recuperator and a second recuperator, and the turbine may include a first turbine and a second turbine, the working fluid passing through the first turbine may be transmitted to the first recuperator to be cooled, and the working fluid passing through the second turbine may be transmitted to the second recuperator to be cooled.

The heat exchanger may include a first heater and a second heater, the first recuperator and the first heater may be a hot side, the second recuperator and the second heater may be a cold side, and the working fluid branched from the rear end of the compressor may be transmitted to the second heater and the first and second recuperators, respectively.

The working fluids transmitted to the second heater and the second recuperator, respectively, may be mixed at a front end of the first heater, heated by the first heater to be supplied to the first turbine, and the working fluid transmitted to the first recuperator may exchange heat with the working fluid passing through the first turbine to be heated and may then be supplied to the second turbine.

The first turbine may be on a high pressure side, the second turbine may be on a low pressure side, and a flow rate of the working fluid supplied to the first turbine may be larger than that supplied to the second turbine.

The flow rate of the working fluid supplied to the first turbine may be a sum of the flow rates of the working fluids supplied to the second heater and the second recuperator.

The second heater and the first heater and the second recuperator and the first recuperator may be controlled to keep a temperature difference between a high temperature portion and a low temperature portion constant.

The working fluids cooled by passing through the second recuperator and the first recuperator may be mixed with each other at a front end of the pre-cooler to be supplied to the pre-cooler.

A flow rate of the working fluid branched to the recuperator from the rear end of the compressor may be branched once more and may be transmitted to the plurality of recuperators, respectively.

In accordance with another aspect, a supercritical $CO_2$ generation system for a parallel recuperative type includes a compressor compressing a working fluid, a low temperature heater and a high temperature heater supplied heat from an external heat source to heat the working fluid, a high pressure turbine driven by the working fluid heated by passing through the low temperature heater and the high temperature heater, a low temperature recuperator and a high temperature recuperator recuperating the working fluid passing through the compressor, a low pressure turbine driven by the working fluid recuperated by the high temperature recuperator; a pre-cooler cooling the working fluid primarily cooled by the recuperator and supplying the cooled working fluid to the compressor, and a separator branching the working fluid passing through the compressor to the low temperature heater, the low temperature recuperator and the high temperature recuperator, respectively, in which the low temperature recuperator and the high temperature recuperator may be installed in parallel.

In accordance with still another aspect, a supercritical $CO_2$ generation system for a parallel recuperative type includes a compressor compressing a working fluid, a low temperature heater and a high temperature heater supplied heat from an external heat source to heat the working fluid, a high pressure turbine driven by the working fluid heated by passing through the low temperature heater and the high temperature heater, a low temperature recuperator and a high temperature recuperator recuperating the working fluid passing through the compressor a low pressure turbine driven by the working fluid recuperated by the high temperature recuperator, a pre-cooler cooling the working fluid primarily cooled by the recuperator and supplying the cooled working fluid to the compressor, and a first separator branching the working fluid passing through the compressor to the low temperature heater, the low temperature recuperator, and the high temperature recuperator, respectively, and a second separator branching the working fluid branched to the low temperature recuperator and the high temperature recuperator from the first separator to the low temperature recuperator and the high temperature recuperator, respectively, in which the low temperature recuperator and the high temperature recuperator are installed in parallel.

The working fluid passing through the high pressure turbine may be transmitted to the high temperature recuperator to be cooled and the working fluid passing through the low pressure turbine may be transmitted to the low temperature recuperator to be cooled.

The heat exchanger may include a high temperature heater and a low temperature heater, and the working fluid branched from a rear end of the compressor may be transmitted to the low temperature heater and the low temperature and high temperature recuperators, respectively.

The working fluids transmitted to the low temperature heater and the low temperature recuperator, respectively, may be mixed with each other at a front end of the high temperature heater to be heated by the high temperature heater and then supplied to the high pressure turbine.

The working fluid transmitted to the high temperature recuperator may exchange heat with the working fluid passing through the high pressure turbine to be heated and then supplied to the low pressure turbine.

A flow rate of the working fluid supplied to the high pressure turbine may be larger than that supplied to the low pressure turbine.

The flow rate of the working fluid supplied to the high pressure turbine may be a sum of the flow rates of the working fluids supplied to the low temperature heater and the low temperature recuperator.

The low temperature heater and the high temperature heater and the low temperature recuperator and the high temperature recuperator may be controlled to keep a temperature difference between a high temperature portion and a low temperature portion constant.

The working fluids cooled by passing through the low temperature recuperator and the high temperature recuperator may be mixed with each other at a front end of the pre-cooler to be supplied to the pre-cooler.

BRIEF DESCRIPTION OF THE DRAWINGS

The above and other objects, features and other advantages will be more clearly understood from the following detailed description taken in conjunction with the accompanying drawings, in which.

DETAILED DESCRIPTION

Hereinafter, a supercritical $CO_2$ generation system for a parallel recuperative type according to an exemplary embodiment o will be described in detail with reference to the accompanying drawings.

Generally, the supercritical $CO_2$ generation system configures a closed cycle in which $CO_2$ used for power generation is not emitted to the outside, and uses supercritical $CO_2$ as a working fluid to construct a single phase generation system. The supercritical $CO_2$ generation system uses the $CO_2$ as the working fluid and therefore may use exhaust gas emitted from a thermal power plant, etc., such that it may be used in a single generation system and a hybrid generation system with the thermal generation system. The working fluid of the supercritical $CO_2$ generation system may also supply $CO_2$ separated from the exhaust gas and may also supply separate $CO_2$.

A working fluid in a cycle that is a supercritical $CO_2$ becomes a high temperature and high pressure working fluid while passing through a compressor and a heater to drive a turbine. The turbine is connected to a generator and the generator is driven by the turbine to produce power. Alternatively, the turbine and the compressor may be coaxially connected to each other, and then the compressor may be provided with a gear box or the like to be connected to the generator. The working fluid used to produce power is cooled while passing through heat exchangers such as a recuperator and a pre-cooler and the cooled working fluid is again supplied to the compressor and is circulated within the cycle. The turbine or the heat exchanger may be provided in plural.

The supercritical $CO_2$ generation system according to various exemplary embodiments refers to a system where all the working fluids flowing within the cycle are in the supercritical state as well as a system where most of the working fluids are in the supercritical state and the rest of the working fluids are in a subcritical state. Further, in various exemplary embodiments, the $CO_2$ is used as the working fluid. Here, $CO_2$ refers to pure carbon dioxide in a chemical meaning as well as carbon dioxide including some impurities and even a fluid in which carbon dioxide is mixed with one or more fluids as additives in general terms.

Figure 1:
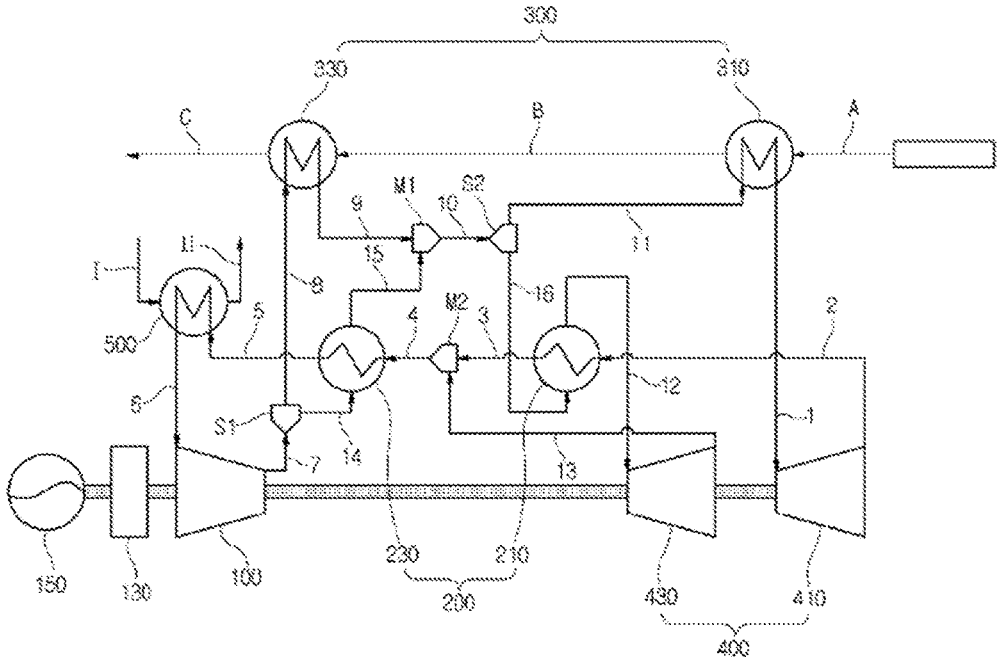
FIG. 1 is a schematic diagram showing the existing EPRI proposed cycle.
Figure 2:
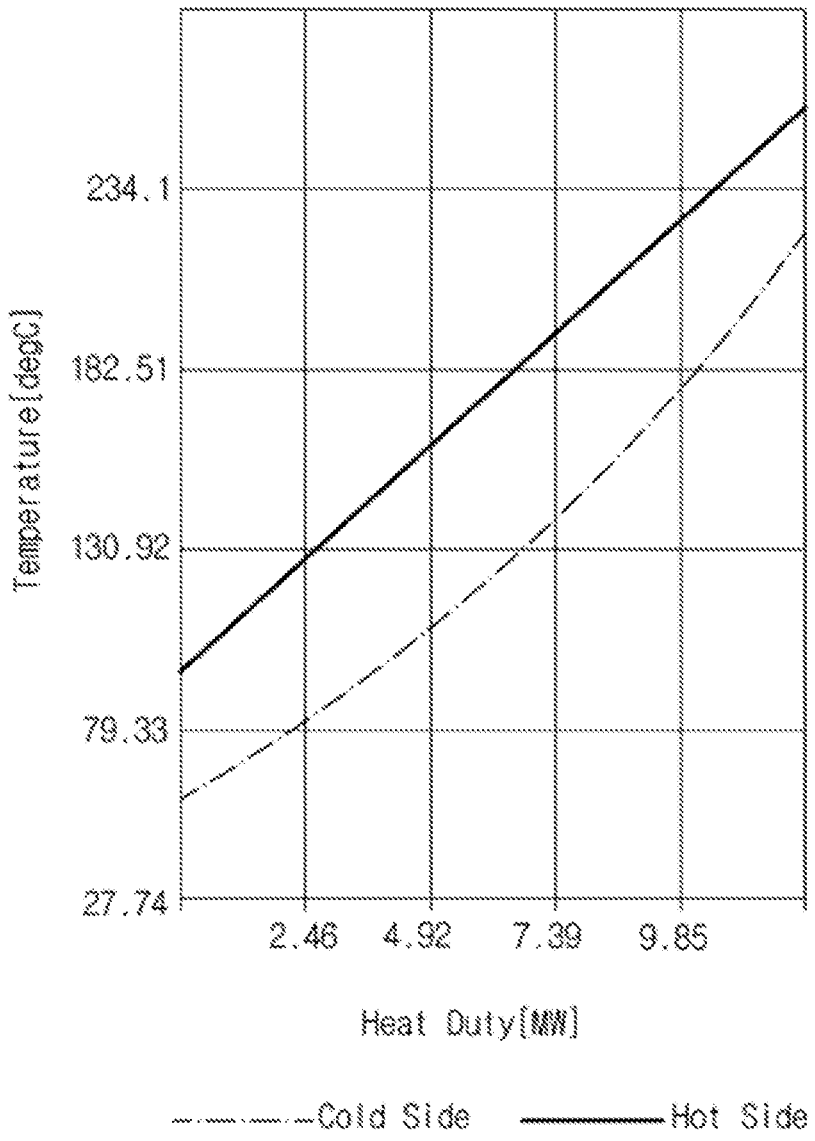
FIG. 2 is a graph showing an example of a uniform temperature distribution on a heat transfer surface inside a heat exchanger of the cycle according to FIG. 1.
Figure 3:
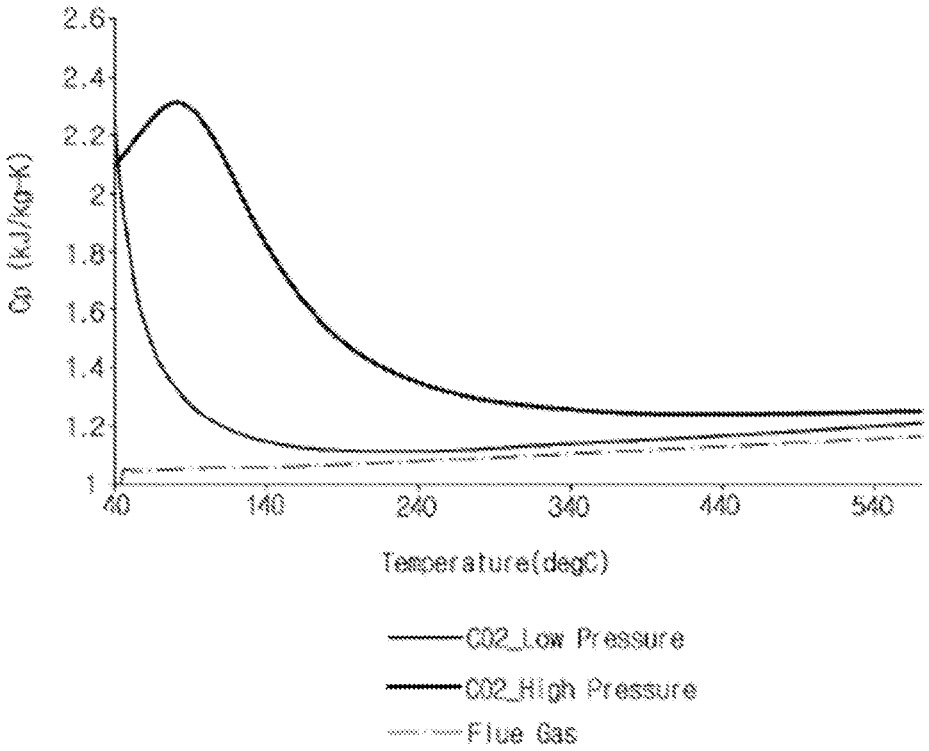
FIG. 3 is a graph showing properties of a working fluid in the cycle according to FIG. 1.
Figure 4:
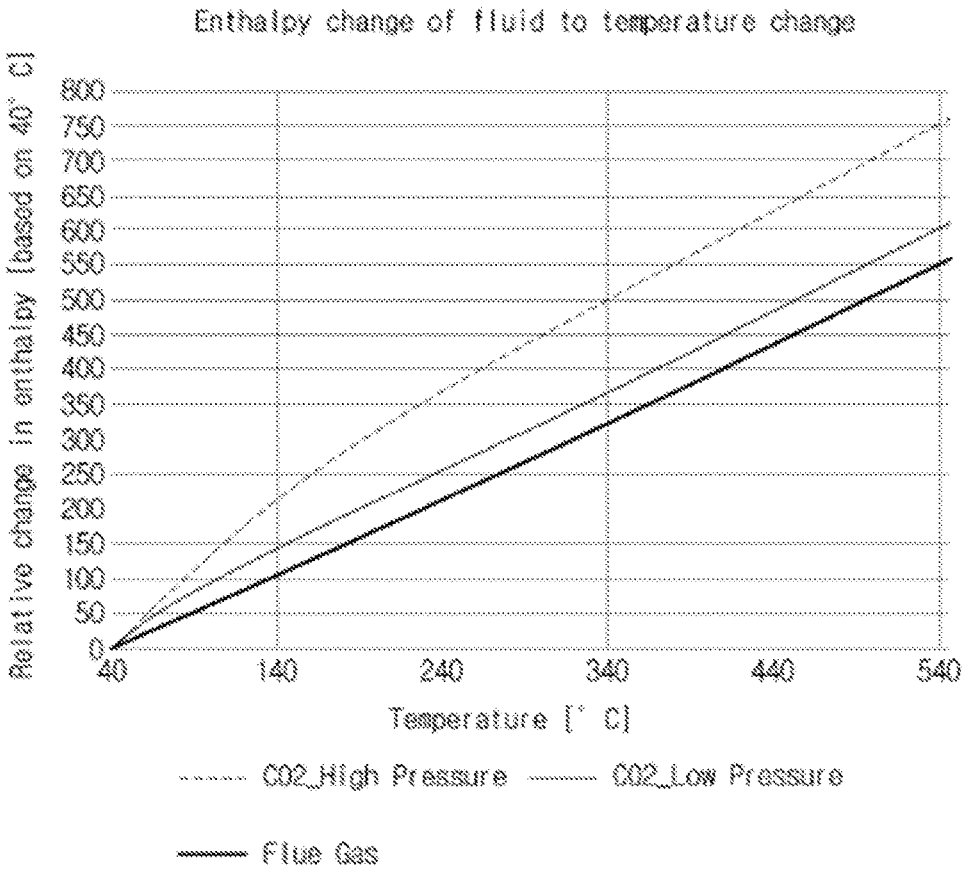
FIG. 4 is a graph showing an enthalpy change of the fluid to a temperature change in the cycle according to FIG. 1.

FIG. 2 is a graph showing an example of a uniform temperature distribution on a heat transfer surface inside a heat exchanger of the cycle according to FIG. 1. FIG. 3 is a graph showing properties of a working fluid in the cycle according to FIG. 1. FIG. 4 is a graph showing an enthalpy change of the fluid to a temperature change in the cycle according to FIG. 1.

Describing the existing EPRI proposed cycle by way of example (see FIG. 1), in order to efficiently transfer heat from a high temperature portion to a low temperature portion inside the recuperator 200 that is the heat exchanger, the temperature distribution (temperature difference) needs to be maintained uniformly over the whole heat transfer surface, which the heat exchanger generates, as shown in FIG. 2.

As shown in FIG. 3, the constant heat capacity Cp at a constant pressure of a section where the supercritical $CO_2$ generation cycle is operated (high pressure portion of 20 MPa or higher and low pressure portion of 85 MPa or lower) are suddenly changed at 230° C. or less. As a result, energy (enthalpy change) required to increase the same temperature has non-linearity (different an energy change rates) in a low temperature region (240° C. or less) as shown in FIG. 4.

Therefore, a uniform heat exchange can be made in the recuperator only when the flow rate of the working fluid needs to be distributed to correspond to different energy change rates. To this end, a supercritical $CO_2$ generation system for a parallel recuperative type having a plurality of heaters arranged in parallel and using an external heat source such as waste heat is proposed as described below.

The cycle of the supercritical $CO_2$ generation system for a parallel recuperative type according to an exemplary embodiment will now be described with reference to the drawings. In the present disclosure, it should be understood that the terms "high temperature" and "low temperatures" do not necessarily refer to a particular temperature that is higher or lower than a specified threshold temperature value, but rather should be understood as being relative to each other. The terms "high pressure," "medium pressure," and "low pressure" should be understood in the same manner as described above.

Figure 5:
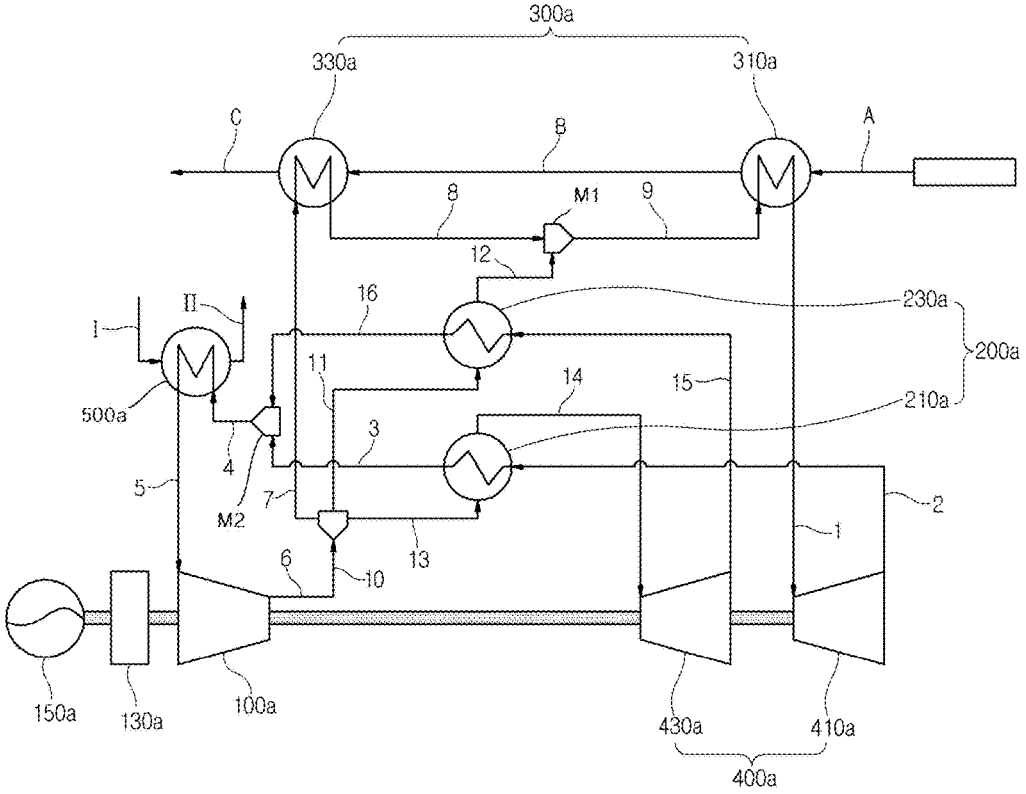
FIG. 5 is a schematic diagram showing a cycle of a supercritical $CO_2$ generation system for a parallel recuperative type according to an exemplary embodiment.

FIG. 5 is a schematic diagram showing a cycle of a supercritical $CO_2$ generation system for a parallel recuperative type according to an exemplary embodiment. Referring to FIG. 5, the generation cycle includes two turbines 400*a* for producing electric power, a pre-cooler 500*a* for cooling a working fluid, and a compressor 100*a* for increasing a pressure of the cooled working fluid, thereby forming high temperature and high pressure working fluid conditions. In addition, two waste heat recovery heat exchangers 300*a* (hereinafter, low temperature heater 330*a* and high temperature heater 310*a*) separated for effective waste heat recovery are provided and two recuperators 200*a* (hereinafter, low temperature recuperator 230*a* and high temperature recuperator 210*a*) for heat exchange of the working fluid are provided. The waste heat recovery heat exchanger 300*a* is provided in series, the recuperator 200*a* is provided in parallel, and a plurality of separators and mixers for distributing a flow rate of the working fluid are provided.

Each of the components is connected to each other by a transfer pipe in which the working fluid flows and unless specially mentioned, it is to be understood that the working fluid flows along the transfer pipe. When a plurality of components are integrated, components and areas actually serving as the transfer pipe may be present the integrated components. Therefore, even in such cases, it is to be understood that the working fluid flows along the transfer pipe.

A high pressure turbine 410*a* and the low pressure turbine 430*a* are driven by the working fluid. First, the high temperature and high pressure working fluid is supplied to the high pressure turbine 410*a* via transfer pipe 1. The mid-temperature and mid-pressure working fluid that drives the high pressure turbine 410*a* and is expanded is transmitted to the high temperature recuperator 210*a* via transfer pipe 2 and exchanges heat with the working fluid passing through the compressor 100*a*. A front end of the pre-cooler 500*a* is provided with a second mixer M2 and the working fluid that is cooled after heat exchange is transmitted to the second mixer M2. The working fluid passing through the high temperature recuperator 210*a* is mixed with the working fluid passing through the low temperature recuperator 230*a* by the second mixer M2 and is transmitted to the pre-cooler 500*a* via transfer pipe 4. The working fluid cooled by the pre-cooler 500*a* is transmitted to the compressor 100*a*, and the flow rate thereof becomes the total flow rate of the cycle (for convenience, mass flow rate is represented by m in the detailed description below). Here, the terms high pressure turbine 410*a* and low pressure turbine 430*a* have relative meanings.

The low temperature and high pressure working fluid that is cooled by the pre-cooler 500*a* and compressed by the compressor 100*a* is transmitted to the separator S1 provided at a rear end of the compressor 100*a* (6). The working fluid is branched from the separator S1 to the low temperature heater 330*a* (7) and branched to the low temperature recuperators 230*a* and 11 and the high temperature recuperator 210*a* and 13, respectively.

The low temperature heater 330*a* and the high temperature heater 310*a* are external heat exchangers that heat a working fluid using an external heat source of a cycle such as waste heat, and use, as a heat source, gas (hereinafter, waste heat gas) having waste heat, such as exhaust gas emitted from a boiler of a generator. The low temperature heater 330*a* and the high temperature heater 310*a* serve to exchange heat between the waste heat gas and the working fluid circulated within the cycle, thereby heating the working fluid with heat supplied from the waste heat gas. As the heat exchanger approaches the external heat source, the heat exchange is made at a higher temperature, and as the heat exchanger approaches an outlet end through which the waste heat gas is discharged, the heat exchange is made at a low temperature. The waste heat gas is introduced into the high temperature heater 310*a* from the high temperature heater via transfer pipe A, then introduced into the low temperature heater 330*a* through the high temperature heater 310*a* via transfer pipe B, and then discharged to the outside through the low temperature heater 330*a* via transfer pipe C. Therefore, the high temperature heater 310*a* is a heat exchanger close to the external heat source, and the low temperature heater 330*a* is a heat exchanger far away from the external heat source and the high temperature heater 310*a*.

The working fluid branched to the low temperature heater 330*a* exchanges heat with the waste heat gas to be primarily heated and is then transmitted to the first mixer M1 installed at the rear end of the low temperature heater 330*a* via transfer pipe 8. On the other hand, the working fluid branched to the low temperature recuperator 230*a* exchanges heat with the working fluid passing through the low pressure turbine 430*a* to be primarily heated and is then transmitted to the first mixer M1 via transfer pipe 12. The working fluids passing through the low temperature heater 330*a* and the low temperature recuperator 230*a* are mixed with each other by the first mixer M1 and then transmitted to the high temperature heater 310*a* via transfer pipe 9. The high temperature and high pressure fluid finally heated by the high temperature heater 310*a* is transmitted to the high pressure turbine 410*a* via transfer pipe 1 as described above.

If the flow rate branched to the low temperature heater 330*a* is mf1 and the flow rate branched to the low temperature recuperator 230*a* is mf2, the flow rate of the working fluid passing through the first mixer M1 becomes m (f1+f2). The flow rate is a flow rate obtained by excluding the flow rate mf3 branched to the high temperature recuperator 210*a* from the total flow rate m of the working fluid, and the flow rate m (f1+f2) of the working fluid passing through the first mixer M1 is preferably set to be larger than the flow rate transmitted to the low pressure turbine 430*a*.

The working fluid branched to the high temperature recuperator 210*a* exchanges heat with the working fluid passing through the high pressure turbine 410*a* to be heated, and is then transmitted to the low pressure turbine 430*a* via transfer pipe 14. The working fluid that drives the low pressure turbine 430*a* is transmitted to the low temperature recuperator 230*a* via transfer pipe 15, then exchanges heat with the working fluid passing through the compressor 100*a* to be cooled, and is then transmitted to the second mixer M2. By this process, the working fluid is circulated within the cycle to drive the turbine and to generate the work of the turbine.

The high pressure turbine 410*a* and the low pressure turbine 430*a* are coaxially connected and the compressor is also coaxially connected to drive the compressor 100*a*. In this case, the compressor 100*a* or the turbine side is connected to the gear box 130*a* so that the power transmitted from the turbine 400*a* to the compressor 100*a* is converted to be suitable for the generator 150*a* and is transmitted to drive the generator 150*a*.

The turbine and the compressor are arranged independently, but the generator is connected to the high pressure turbine to be driven, and the compressor may be configured to be driven by the low pressure turbine. Alternatively, the plurality of turbines are coaxially connected to each other and any one thereof is connected to a generator, and the compressor may also be configured to have a separate drive motor.

In the cycle of the supercritical $CO_2$ generation system for a parallel recuperative type according to the exemplary embodiment having the above-described configuration, the flow rate control suitable for the present system can be performed by utilizing physical properties according to an operation section (pressure) of the waste heat gas and the working fluid.

Figure 6:
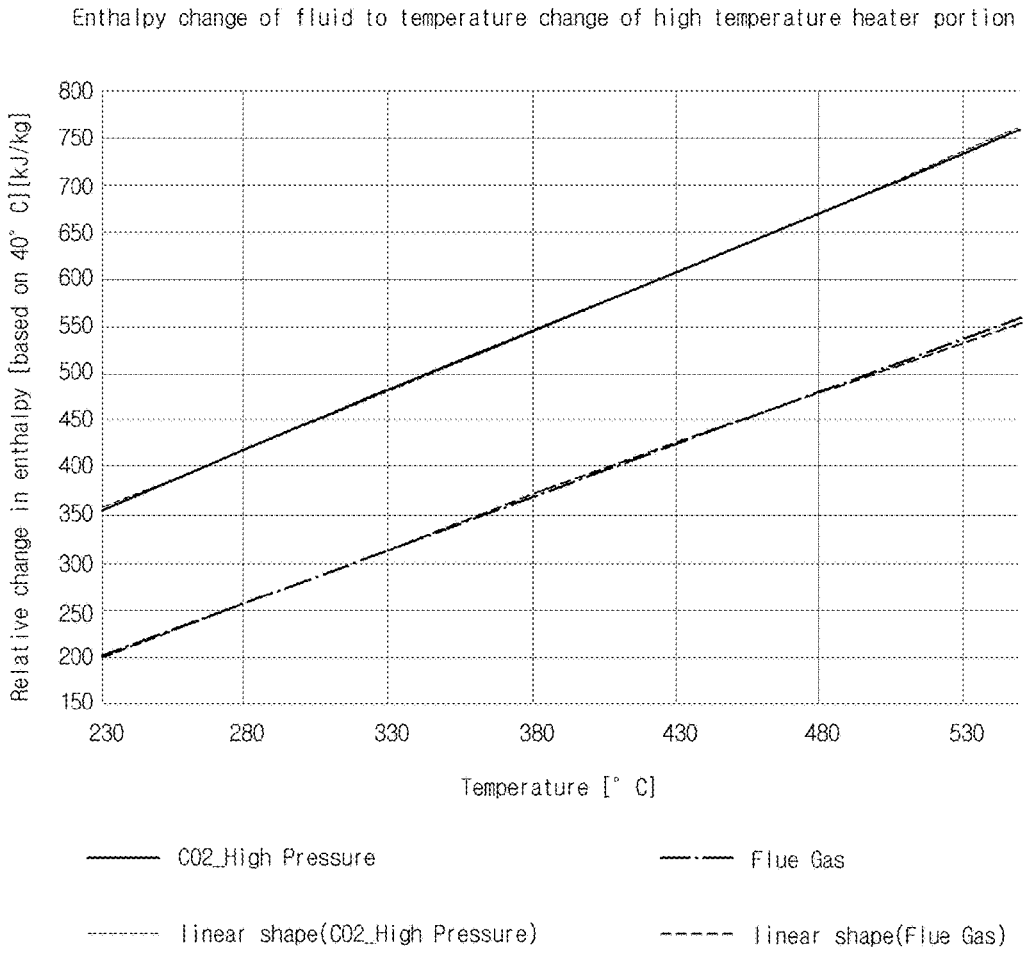
FIG. 6 is a graph showing an example of an enthalpy change of another fluid to a temperature change of a high temperature heater in the cycle of FIG. 5.
Figure 7:
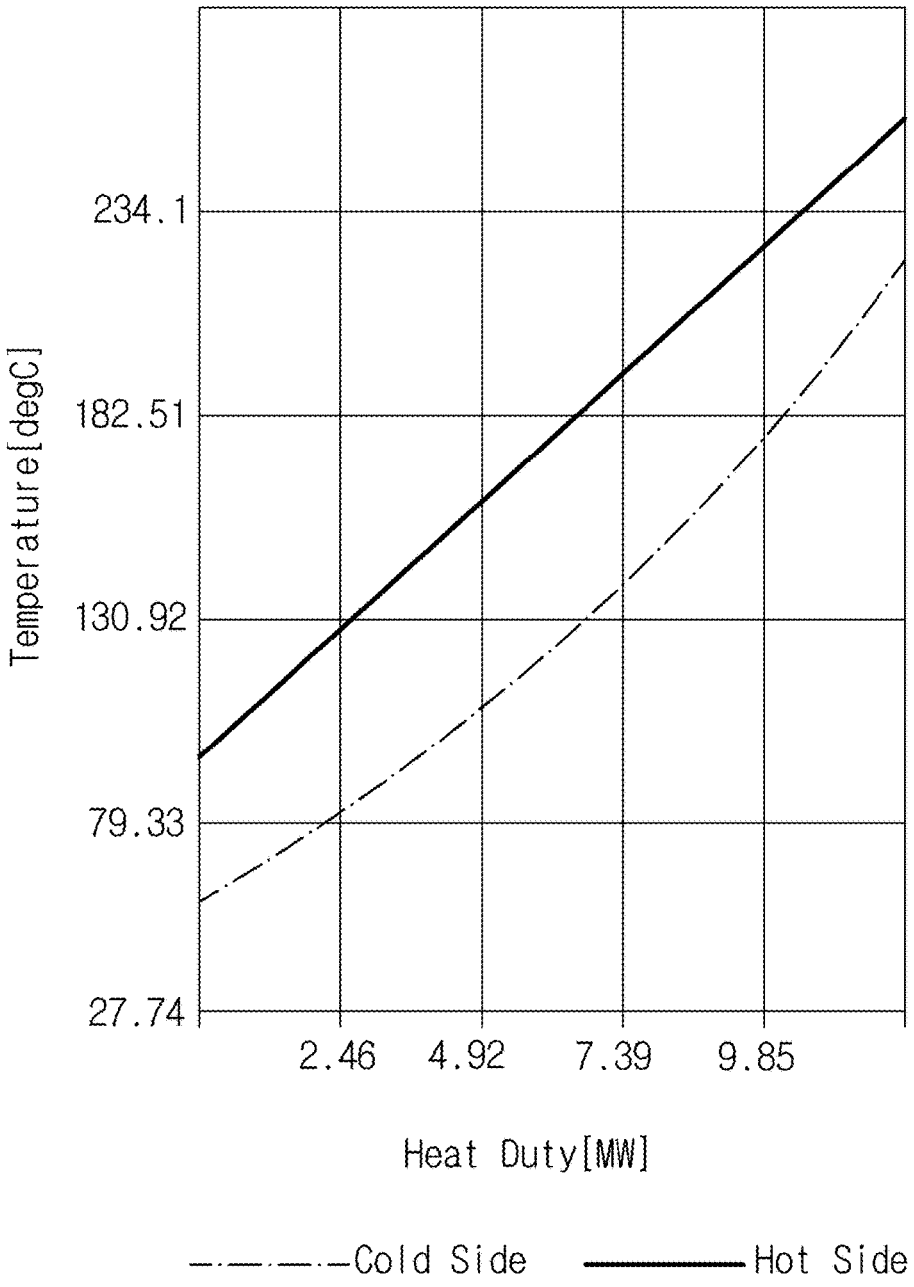
FIG. 7 is a graph showing an example of a temperature distribution of a low temperature heater in the cycle of FIG. 5.
Figure 8:
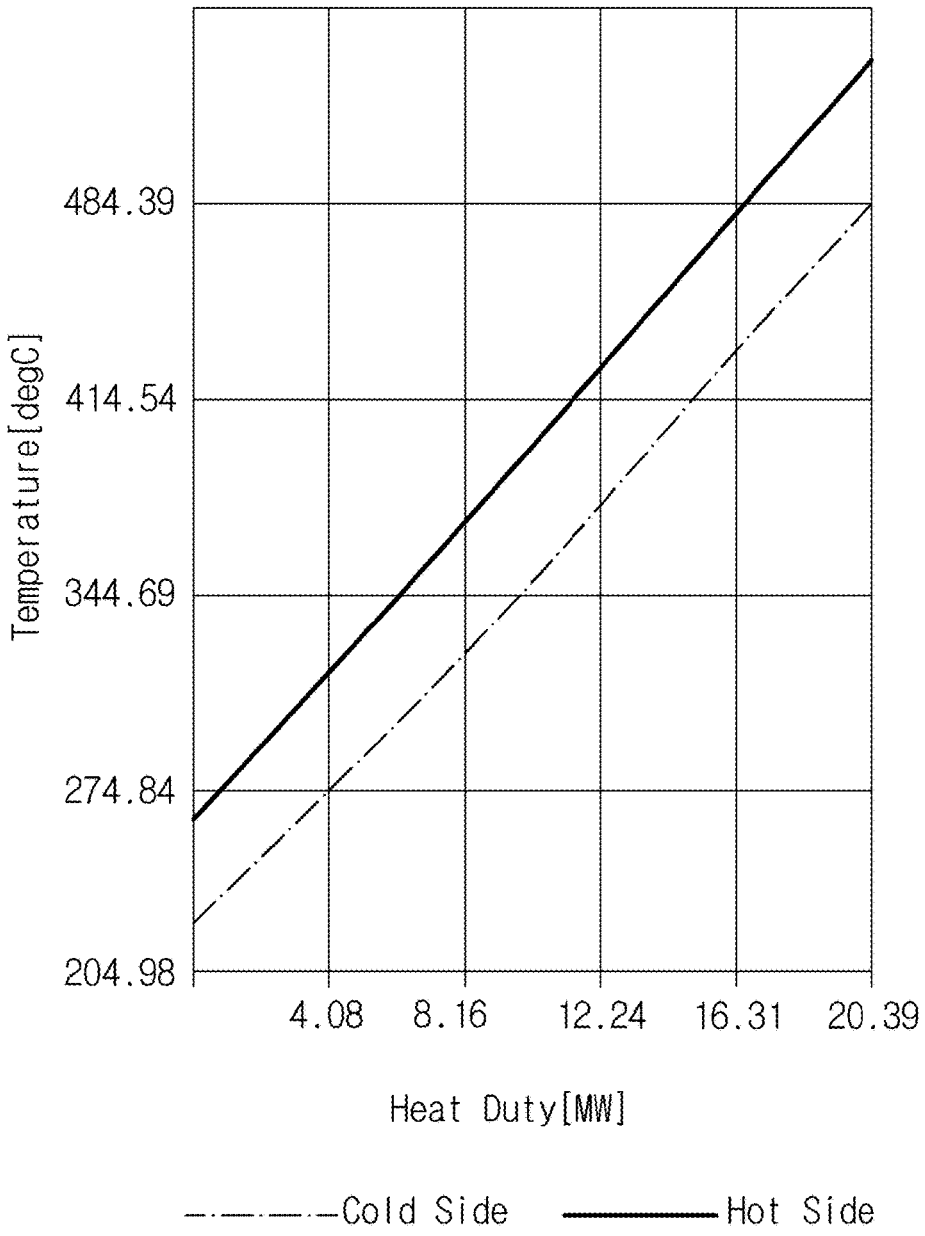
FIG. 8 is a graph showing an example of a temperature distribution of a high temperature heater in the cycle of FIG. 5.
Figure 9:
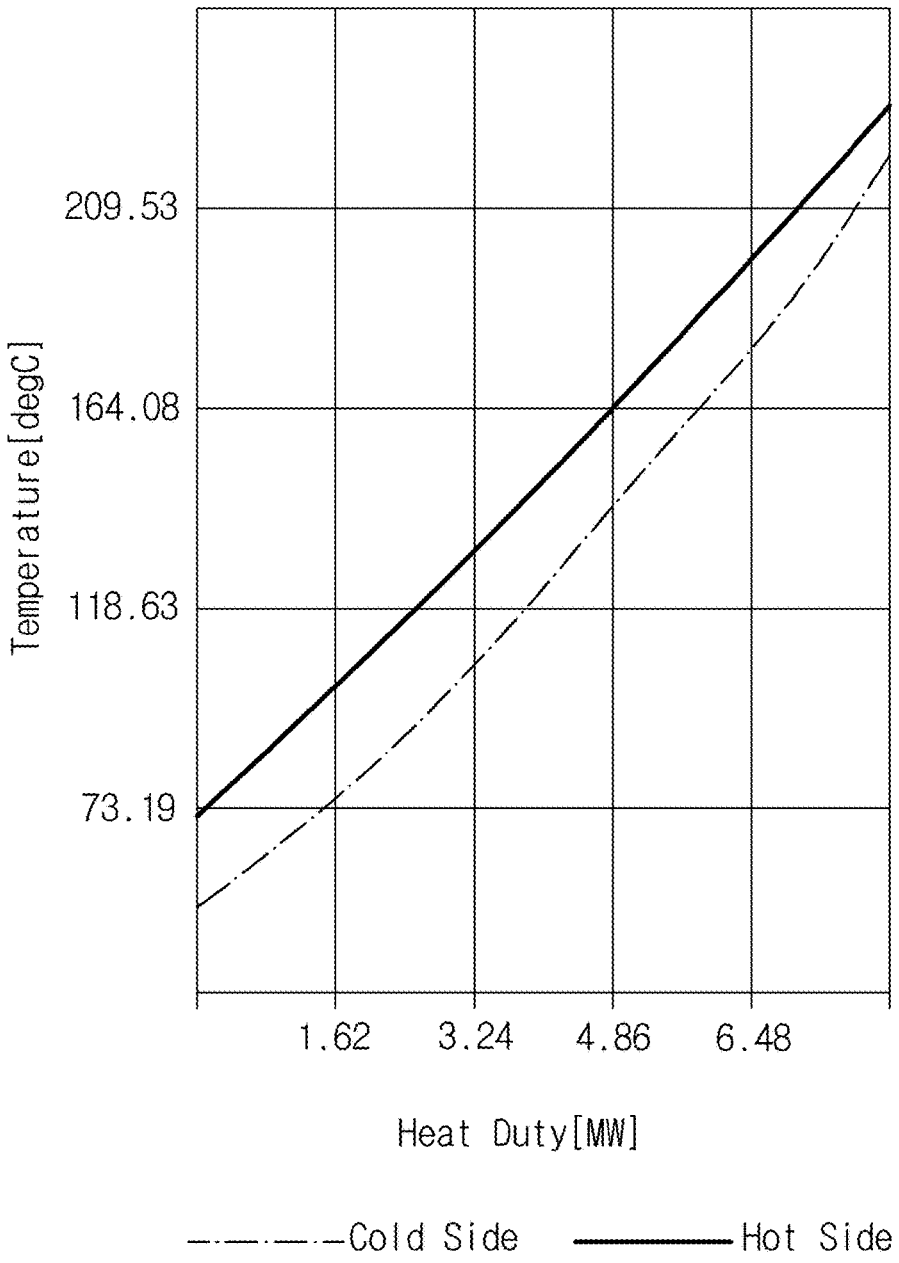
FIG. 9 is a graph showing an example of a temperature distribution of a low temperature recuperator in the cycle of FIG. 5.
Figure 10:
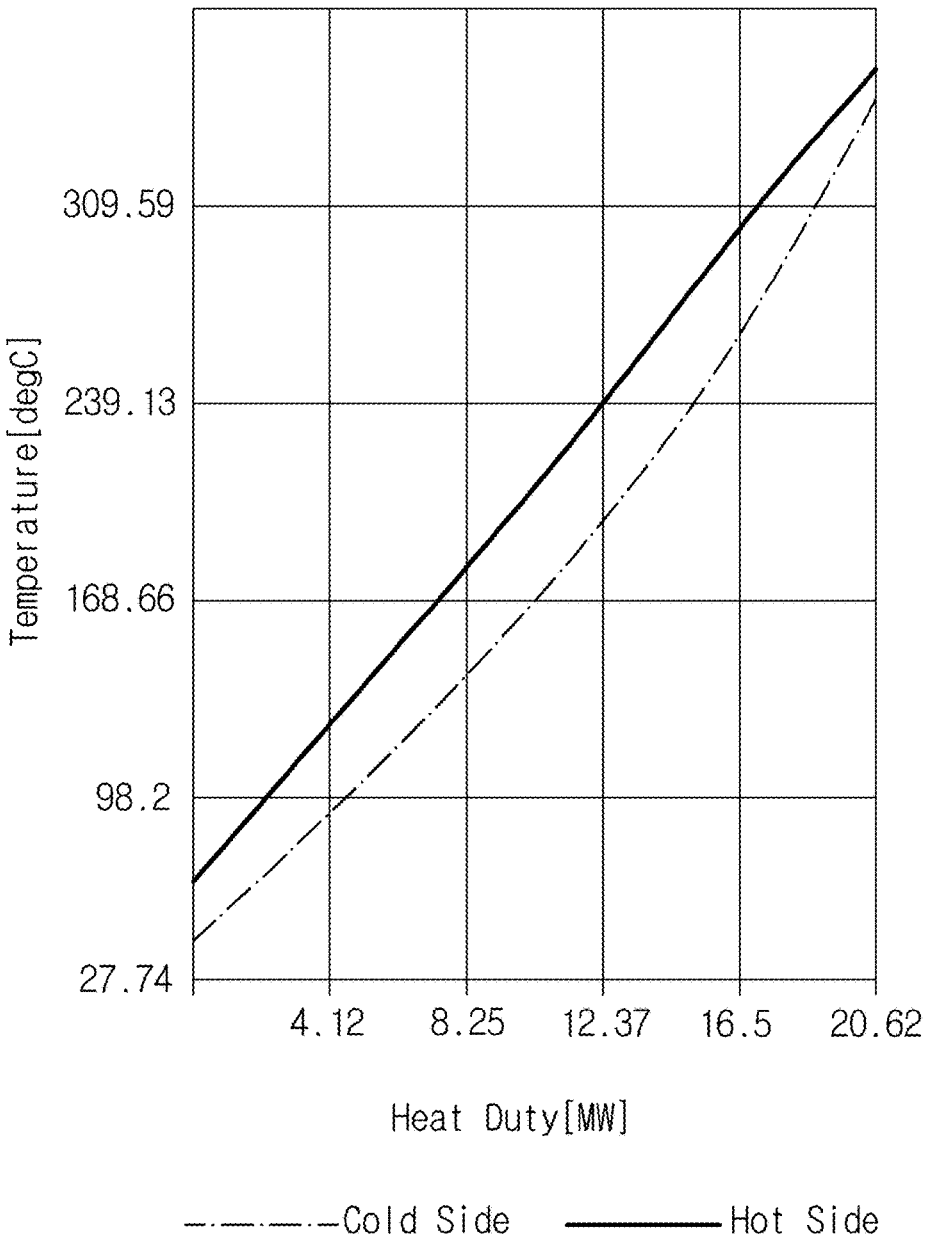
FIG. 10 is a graph showing an example of the temperature distribution of the high temperature heater in the cycle of FIG. 5.
Figure 11:
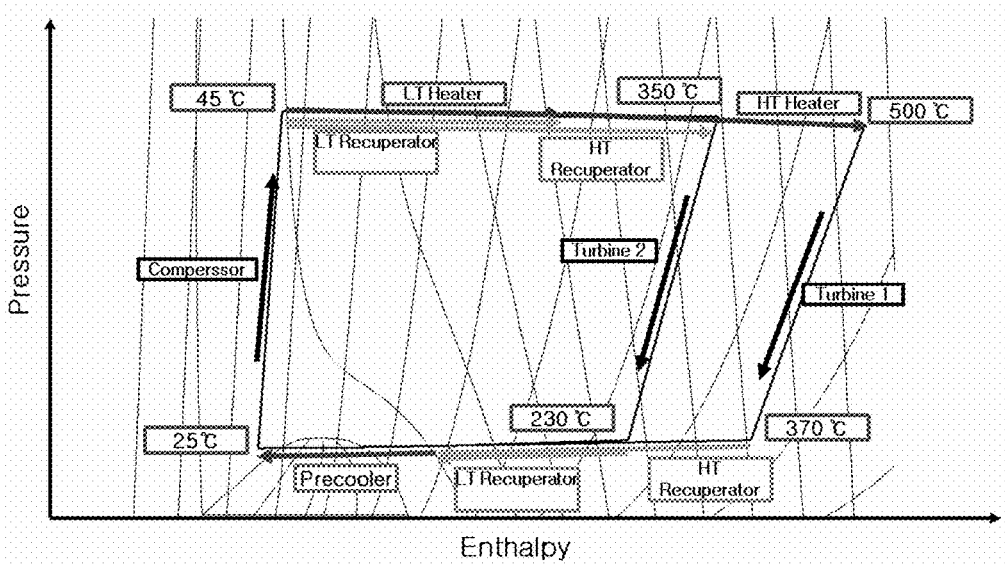
FIG. 11 is a P-H diagram according to the cycle of FIG. 5.

FIG. 6 is a graph showing an example of an enthalpy change of another fluid to a temperature change of a high temperature heater in the cycle of FIG. 5. FIG. 7 is a graph showing an example of a temperature distribution of a low temperature heater in the cycle of FIG. 5. FIG. 8 is a graph showing an example of a temperature distribution of a high temperature heater in the cycle of FIG. 5. FIG. 9 is a graph showing an example of a temperature distribution of a low temperature recuperator in the cycle of FIG. 5. FIG. 10 is a graph showing an example of the temperature distribution of the high temperature heater in the cycle of FIG. 5. FIG. 11 is a P-H diagram according to the cycle of FIG. 5.

As shown in FIG. 6, the operation period of the high temperature heater 310*a* that exchanges heat with the waste heat gas exhibits a linear change in energy change (change rate) to temperature. Therefore, the flow rate may be distributed by a ratio of the change rate. For example, if a flow rate A of waste heat gas is a kg/s, a flow rate 9 of the working fluid transmitted from the first mixer M1 to the high temperature heater 310*a* is about 0.9 a kg/s (value obtained by dividing 1.1174 by 1.2561). Therefore, the flow rate may be distributed to maintain a mass balance of the entire system while keeping the temperature difference between the high and low temperature portions of each heat exchanger (recuperator and heater) constant (FIGS. 7 to 10) by utilizing physical properties according to the pressure of the working fluid in each operation region. In this way, it is possible to distribute the flow rate so that f1 may be set to be about 36%, f2 may be set to be about 24%, and f3 may be set to be about 40%. In this case, as shown in FIGS. 7 to 10, the supercritical $CO_2$ generation system operated while keeping the temperature difference of each heat exchanger constant can be realized.

In the case of the EPRI proposed cycle shown in FIG. 1, the following conditions are required for four heat exchangers (low temperature and high temperature heaters, two recuperators) to have the same temperature distribution.

1) The flow rate of the low temperature recuperator is always the total flow rate of the system.

2) The difference between the outlet temperature 5 of the low temperature fluid and the outlet temperature C of the low temperature fluid of the low temperature heater needs to be minimized.

3) The difference between the inlet temperature 1 of the high temperature fluid and the outlet temperature 3 of the high temperature fluid of the high temperature recuperator needs to be minimized.

Only if these conditions are satisfied, four heat exchangers may each have the same temperature distribution, and the inefficiency of heat exchange occurs at the junction point of the first mixer M1 or the second mixer M2.

However, in the case of the parallel recuperative cycle of the present disclosure, the same temperature distributions of each heat exchanger may be maintained as long as the outlet temperatures of the low temperature fluids of the low temperature heater 330*a* and the low temperature recuperator 230*a* are satisfied. Further, even if the temperature difference between the outlets of the high temperature fluids between the low temperature recuperator 230*a* and the high temperature recuperator 210*a* occurs, the recuperators 200*a* are installed in parallel, such that the mixing effect to the low temperature region is insignificant. In addition, since the inlet temperature of the compressor 100*a* is maintained at a flow rate of a cooling source in the pre-cooler 500*a*, there is no concern about the drivability.

In addition, the parallel recuperative cycle of the present disclosure has the effect of minimizing a compression ratio loss of the turbine by arranging the recuperators in parallel. That is, in the case of the high pressure turbine 410*a*, a constant pressure is required at a design temperature (for avoiding the two-phase section of the working fluid) for the stable compression of the working fluid in the compressor 100*a* and the stability of the compressor. However, if the recuperators 200*a* are arranged in parallel, the working fluid passing through the high pressure turbine 410*a* passes through only one high temperature recuperator 210*a*, and therefore the pressure loss is reduced. For example, in the P-H diagram of FIG. 11, it can be seen that the working fluid passing through the Turbine 1 is cooled at almost an equal pressure while passing through the high temperature recuperator 210*a*. That is, there is an effect of increasing the compression ratio by lowering the outlet pressure of the high pressure turbine 410*a*.

Even in the case of the low pressure turbine 430*a*, since the working fluid discharged from the compressor 100*a* passes through only one low temperature recuperator 230*a*, the pressure loss is reduced, such that the inlet pressure of the low pressure turbine 430*a* is increased. For example, in the P-H diagram of FIG. 11, it can be seen that the working fluid passing through the Turbine 2 is cooled at almost an equal pressure while passing through the low temperature recuperator 230*a*. Accordingly, the compression ratio of the low pressure turbine 430*a* can be increased.

Figure 12:
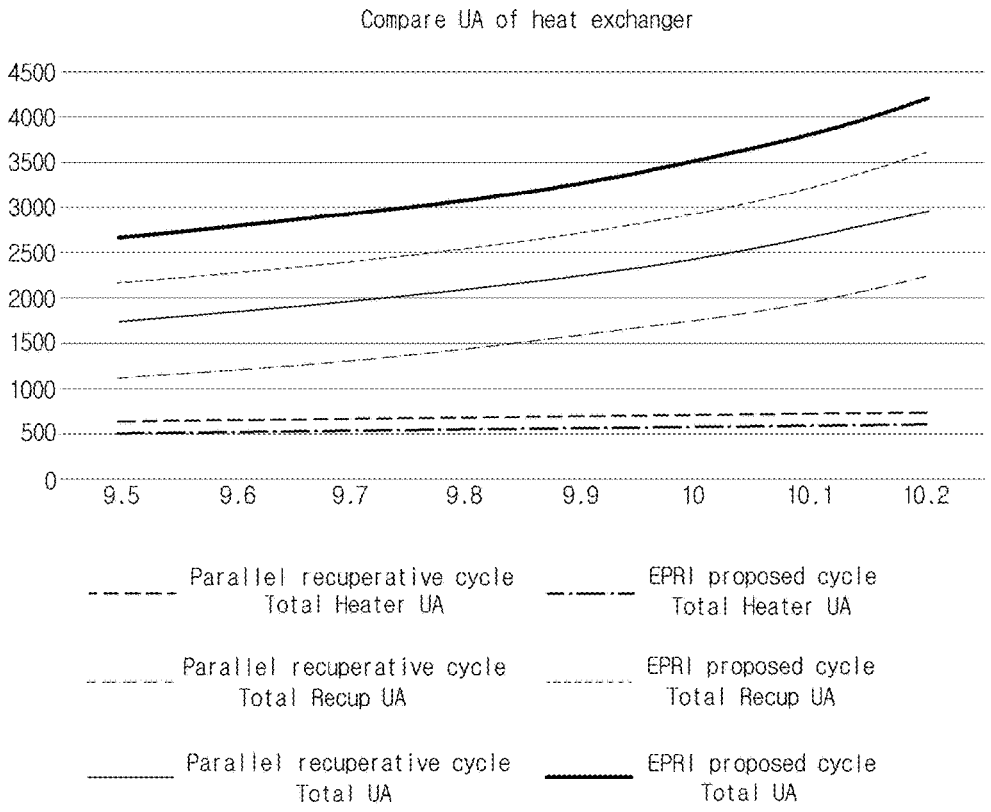
FIG. 12 is a graph comparing the existing EPRI proposed cycle with the UA of the heat exchanger in the cycle of FIG. 5.

The parallel recuperative cycle of the present disclosure is also advantageous in terms of costs. FIG. 12 is a graph comparing the existing EPRI proposed cycle with the UA (U represents a total heat transfer coefficient and A represents a heat transfer area) of the heat exchanger in the cycle of FIG. 5.

Referring to FIG. 12, the total UA of the low temperature heater 330*a* and the high temperature heater 310*a* according to the parallel recuperative cycle of the exemplary embodiment is slightly larger than the total UA of the low temperature heater 330*a* and the high temperature heater 310*a* according to the existing EPRI proposed cycle. However, it can be seen that the total UA of the low temperature recuperator 230*a* and the high temperature recuperator 210*a* according to the parallel recuperative cycle of the exemplary embodiment is much smaller than the total UA of the low temperature recuperator 230 and the high temperature recuperator 210 according to the existing EPRI proposed cycle. Therefore, since the total UA according to the parallel recuperative cycle of the exemplary embodiment is smaller than the total UA according to the existing EPRI proposed cycle, it is also effective in terms of cost.

The supercritical $CO_2$ generation system for a parallel recuperative type according to the exemplary embodiment having the above-described effects may include an additional separator to constitute a cycle (the detailed description of the same components as those in the above embodiment will be omitted).

Figure 13:
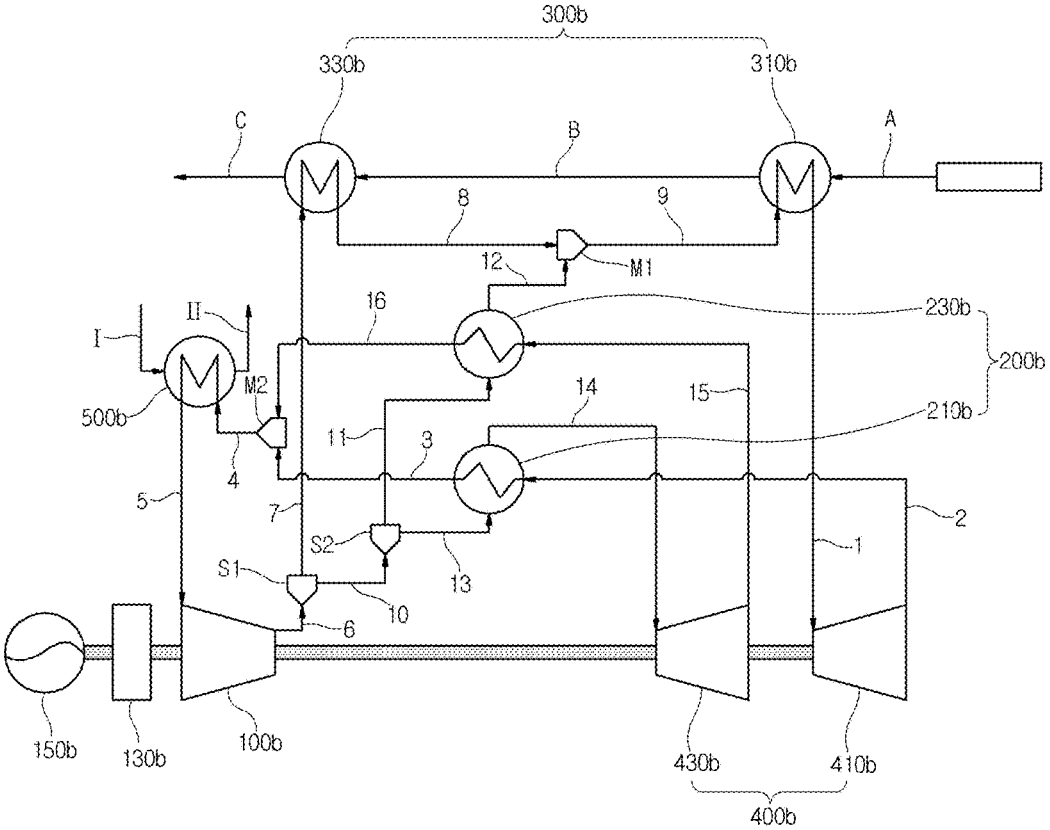
FIG. 13 is a schematic diagram showing a cycle of a supercritical $CO_2$ generation system for a parallel recuperative type according to another exemplary embodiment.

FIG. 13 is a schematic diagram showing a cycle of a supercritical $CO_2$ generation system for a parallel recuperative type according to another exemplary embodiment. As shown in FIG. 13, in the supercritical $CO_2$ generation system for a parallel recuperative type according to another exemplary embodiment, the rear end of the compressor 100*b* is provided with the first separator S1 and the working fluid is branched in the low temperature heater 330*b* direction via transfer pipe 7 and the recuperator 200*b* direction via transfer pipe 10 from the first separator S1. The working fluid branched to the recuperator 200*b* is again branched to the high temperature recuperators 210*b* via transfer pipe 13 and the low temperature recuperator 230*b* via transfer pipe 11, respectively, via the second separator S2.

If the flow rate of the working fluid branched from the first separator S1 to the low temperature heater 330*b* is mf1, the flow rate of the working fluid branched to the recuperator 200*b* is m (1−f1). The flow rate of the working fluid branched from the second separator S2 to the low temperature recuperator 230*b* is m (1−f1) f2 and the flow rate of the working fluid branched to the high temperature recuperator 210*b* is m (1−f1) (1−f2). The flow rate of the working fluid flowing toward the high pressure turbine 410*b* is controlled to be larger than the flow rate of the working fluid flowing toward the low pressure turbine 430*b*, as in the above exemplary embodiment. Therefore, the flow rate of the working fluid branched to the low temperature recuperator 230*b* is preferably set to be larger than the flow rate of the working fluid branched to the high temperature recuperator 210*b*

Even if the cycle is configured as described above, the working fluids passing through the high pressure turbine 410*b* and the low pressure turbine 430*b* each passes through only one of the high temperature recuperator 210*b* and the low temperature recuperator 230*b*, and recuperated, such that the pressure loss of the working fluid may be reduced. In addition, the present cycle also has the same effect as the above-described exemplary embodiment.

According to the supercritical $CO_2$ generation system for parallel recuperative type according to the exemplary embodiment, the compression ratio of the turbine can be increased by arranging the recuperators in parallel, thereby maximizing the work of the turbine. Further, the heat transfer temperature distributions of the high temperature portions and the low temperature portions of the plurality of heaters and the recuperator are uniform, and therefore the flow rate distribution can be made, thereby maximizing the heat exchange efficiency.

Even if the temperature difference in the outlets of the high temperature fluids occurs in the two recuperators due to the parallel arrangement of the recuperators, the mixing effect to the low temperature area is insignificant. Since the pre-cooler keeps the inlet temperature of the compressor at the flow rate of the cooling source, there is no concern about the driving performance. Furthermore, since the UA of the heat exchanger is small at the time of generating the same power to the existing cycle, costs can be saved.

The various exemplary embodiments described as above and shown in the drawings should not be interpreted as limiting the technical spirit of the present invention. The scope of the present disclosure is limited only by matters set forth in the claims and those skilled in the art can modify and change the technical subjects of the present invention in various forms.

What is claimed is:

1. A supercritical $CO_2$ generation system comprising:

a compressor compressing a working fluid;

a pre-cooler for cooling the working fluid and supplying pre-cooled working fluid to the compressor;

a heat exchanger unit including first and second heaters configured to heat the working fluid;

first and second turbines respectively driven by the working fluid; and a recuperator unit including a first recuperator and a second recuperator installed in parallel to each other such that the working fluids cooled by passing through the first and second recuperators are mixed with each other at a downstream side of the recuperator unit and supplied to the pre-cooler, the recuperator unit exchanging heat between the working fluid having passed through the first and second turbines and the working fluid having passed through the compressor to cool the working fluid having passed through the first and second turbines, wherein the working fluids having passed through the second heater and the second recuperator, respectively, are mixed at an upstream side of the first heater, and wherein the mixed working fluids are heated by the first heater and then supplied to the first turbine.

2. The supercritical $CO_2$ generation system of claim 1, wherein the working fluid having passed through the compressor is branched to the heat exchanger unit and the recuperator unit from a downstream side of the compressor, respectively.

3. The supercritical $CO_2$ generation system of claim 1, wherein the working fluid having passed through the first turbine is transmitted to the first recuperator to be cooled, and wherein the working fluid having passed through the second turbine is transmitted to the second recuperator to be cooled.

4. The supercritical $CO_2$ generation system of claim 1, wherein the first heater is arranged on a high temperature side of the system and the second heater is arranged on a low temperature side of the system, wherein the first recuperator includes a high temperature recuperator and the second recuperator includes a low temperature recuperator, and wherein the working fluid branched from a downstream side of the compressor is transmitted to the second heater and the first and second recuperators, respectively.

5. The supercritical $CO_2$ generation system of claim 1, wherein the working fluid transmitted to the first recuperator exchanges heat with the working fluid having passed through the first turbine to be heated and then is supplied to the second turbine.

6. The supercritical $CO_2$ generation system of claim 1, wherein the first turbine is arranged on a high pressure side of the system, and the second turbine is arranged on a low pressure side of the system, and wherein the working fluid is supplied to the first turbine at a flow rate greater than that of the working fluid supplied to the second turbine.

7. The supercritical $CO_2$ generation system of claim 6, wherein the flow rate of the working fluid supplied to the first turbine is a sum of the flow rates of the working fluids supplied to the second heater and the second recuperator.

8. The supercritical $CO_2$ generation system of claim 1, wherein each of the first and second heaters and the first and second recuperators includes a heat exchanger having a high temperature operation region and a low temperature operation region, and wherein each heat exchanger is controlled to keep constant a temperature difference between the high and low temperature operation regions.

9. The supercritical $CO_2$ generation system of claim 2, wherein the working fluid branched to the recuperator unit from the downstream side of the compressor is branched to the first and second recuperators, respectively.

10. A supercritical $CO_2$ generation system comprising:

a compressor compressing a working fluid;

a low temperature heater and a high temperature heater supplied heat from an external heat source to heat the working fluid;

a high pressure turbine driven by the working fluid heated by passing through the low temperature heater and the high temperature heater;

a low temperature recuperator and a high temperature recuperator installed in parallel to each other and configured to recuperate the working fluid passing through the compressor;

a low pressure turbine driven by the working fluid recuperated by the high temperature recuperator;

a pre-cooler cooling the working fluid primarily cooled by the high temperature recuperator and the low temperature recuperator and supplying the pre-cooled working fluid to the compressor; and a separator branching the working fluid passing through the compressor to the low temperature heater, the low temperature recuperator and the high temperature recuperator, respectively, wherein the working fluids having passed through the low temperature heater and the high temperature recuperator, respectively, are mixed at an upstream side of the high temperature heater and then are heated by the high temperature heater to be supplied to the high pressure turbine.

11. A supercritical $CO_2$ generation system comprising:

a compressor compressing a working fluid;

a low temperature heater and a high temperature heater supplied heat from an external heat source to heat the working fluid;

a high pressure turbine driven by the working fluid heated by passing through the low temperature heater and the high temperature heater;

a low temperature recuperator and a high temperature recuperator installed in parallel to each other and configured to recuperate the working fluid passing through the compressor;

a low pressure turbine driven by the working fluid recuperated by the high temperature recuperator;

a pre-cooler cooling the working fluid primarily cooled by the high temperature recuperator and the low temperature recuperator and supplying the pre-cooled working fluid to the compressor;

a first separator branching the working fluid passing through the compressor to the low temperature heater, the low temperature recuperator, and the high temperature recuperator, respectively; and a second separator branching the working fluid branched to the low temperature recuperator and the high temperature recuperator from the first separator, respectively, wherein the working fluids having passed through the low temperature heater and the high temperature recuperator, respectively, are mixed at an upstream side of the high temperature heater and then are heated by the high temperature heater to be supplied to the high pressure turbine.

12. The supercritical $CO_2$ generation system of claim 11, wherein the working fluid having passed through the high pressure turbine is transmitted to the high temperature recuperator to be cooled and the working fluid having passed through the low pressure turbine is transmitted to the low temperature recuperator to be cooled.

13. The supercritical $CO_2$ generation system of claim 11, wherein the working fluid branched from a downstream side of the compressor is transmitted to the low temperature heater and the low temperature and high temperature recuperators, respectively.

14. The supercritical $CO_2$ generation system of claim 13, wherein the working fluid transmitted to the high temperature recuperator exchanges heat with the working fluid having passed through the high pressure turbine to be heated and then is supplied to the low pressure turbine.

15. The supercritical $CO_2$ generation system of claim 14, wherein the working fluid is supplied to the high pressure turbine at a flow rate greater than that of the working fluid supplied to the low pressure turbine.

16. The supercritical $CO_2$ generation system of claim 15, wherein the flow rate of the working fluid supplied to the high pressure turbine is a sum of the flow rates of the working fluids supplied to the low temperature heater and the low temperature recuperator.

17. The supercritical $CO_2$ generation system of claim 11, wherein each of the high and low temperature heaters and the high and low temperature recuperators includes a heat exchanger having a high temperature operation region and a low temperature operation region, and wherein each heat exchanger is controlled to keep constant a temperature difference between the high and low temperature operation regions.

18. The supercritical $CO_2$ generation system of claim 11, wherein the working fluids cooled by passing through the low temperature recuperator and the high temperature recuperator are mixed with each other at an upstream side of the pre-cooler to be supplied to the pre-cooler.

* * * * *